United States Patent [19]

Braun

[11] 4,293,096

[45] Oct. 6, 1981

[54] ARRANGEMENT IN A BURNER

[75] Inventor: Stellan Braun, Dalby, Sweden

[73] Assignee: AGA Aktiebolag, Lidingo, Sweden

[21] Appl. No.: 125,924

[22] Filed: Feb. 29, 1980

[30] Foreign Application Priority Data

Mar. 1, 1979 [SE] Sweden ..... 7901836

[51] Int. Cl.[3] ..... F23D 11/16

[52] U.S. Cl. ..... 239/419.3; 266/48

[58] Field of Search ..... 239/419.3; 266/48, 49, 266/66, 74, 75

[56] References Cited

U.S. PATENT DOCUMENTS 3,558,062 1/1971 See ..... 39/439.3
3,643,871 2/1972 Hamernik et al. ..... 239/419.3
3,788,558 1/1974 Ujiie ..... 266/74
3,948,496 4/1976 Miller ..... 266/48

*Primary Examiner*—L. Dewayne Rutledge
*Assistant Examiner*—John P. Sheehan
*Attorney, Agent, or Firm*—Larson and Taylor

[57] ABSTRACT

Arrangement in a cutting burner to clean and cool the cutting oxygen channel in the burner nozzle during the heating procedure. The arrangement comprises a connection line with an incorporated throttling member between the heating oxygen gas channel and the cutting oxygen gas channel; and a check valve member in the cutting oxygen gas channel. The valve is situated thus that the portion of the heating oxygen gas flow which passes through the cutting oxygen gas passage is permitted to pass only in the direction towards the nozzle orifices.

3 Claims, 2 Drawing Figures

ARRANGEMENT IN A BURNER

The present invention relates to an arrangement in a cutting burner which comprises a burner body with a nozzle and a valve body to which the supply lines for the respective gas are connected, a cutting oxygen gas channel, a heating oxygen gas channel and a burner gas channel being provided in the burner.

In burner nozzles, it may occur during the stage in which the workpiece is being heated that particles of dirt are drawn up into and foul the cutting oxygen gas channel. If the worst comes to the worst, it may happen that the fouling becomes so severe as to obstruct the passage completely. During the heating stage, it may also occur that the hot gases pass up into the cutting oxygen gas channel and there cause injurious heating of the nozzle. These disadvantages can occur both in machine cutting burners and in hand-held cutting burners.

An object of the present invention is to provide an arrangement whereby these disadvantages are obviated or mitigated. The principal characteristics of the arrangement according to the invention are that provided in the cutting burner between the heating oxygen gas channel and the cutting oxygen gas channel is a connection line at least part of which has a cross section much smaller than the cross section of the heating oxygen channel such that a throttled flow of gas will pass from the heating channel to the cutting channel, and that provided in the cutting oxygen gas channel before the connecting line is a check valve member, by means of which a certain portion of the heating oxygen gas flow is permitted to pass through the cutting oxygen gas passage only in the direction towards the nozzle orifice. The connection line and check valve member can then be disposed in the actual burner body or outside the burner body, for instance in a body disposed between the burner body and valve housing.

Figure 1:
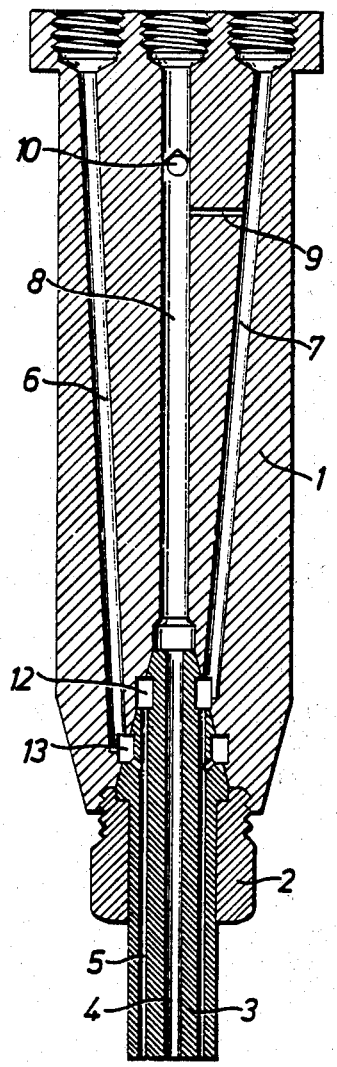
Figure 2:
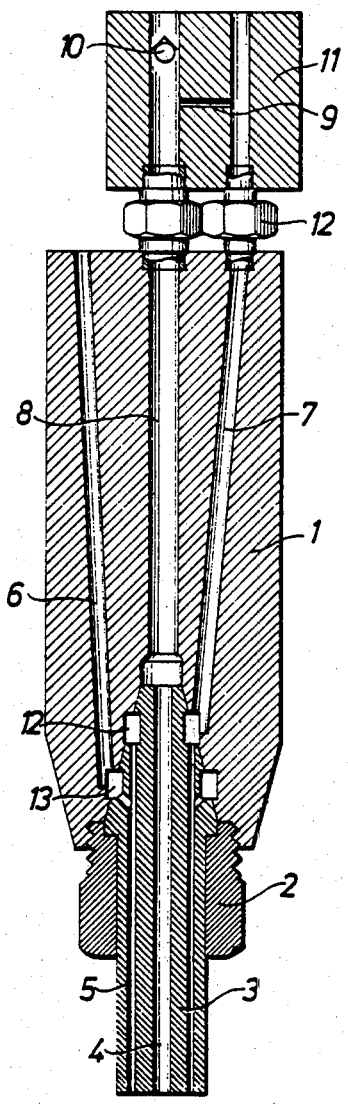

The invention will now be described in more detail and with reference to the accompanying drawings, in which FIG. 1 and FIG. 2 show two embodiments of the arrangement according to the invention.

FIG. 1 shows a cross-section of an embodiment, which shows a burner nozzle comprising a burner body 1, in the lower part of which a nozzle 3 is attached by means of a nozzle holder 2. Centrally disposed in nozzle 3 is a channel 4 for the cutting oxygen gas. Also provided in the nozzle is one or a plurality of heating gas channels 5, which surround the central channel 4. Provided in the burner body 1 is a channel 8 for the cutting oxygen gas, the said channel communicating with the central channel 4 in the nozzle 3. The burner body also incorporates a channel 7 for heating oxygen gas, which via a distribution channel 12 communicates with the channel 5 in the nozzle. Also provided in the burner body 1 is a burner gas channel 6, which via a distribution channel 13 communicates with the heating gas channel 5 in the nozzle 3.

Connected to the upper portion of the burner body is a valve body (not shown in the figure) which is connected via hose sockets to the supply lines for oxygen gas and burner gas. Also provided in the burner body 1 is a communication channel 9 between the cutting oxygen gas channel 8 and the heating oxygen gas channel 7. At least part of the passage 9 is of small cross section relative to heating oxygen channel 7 and thus constitutes a throttled passage relative to channel 7, whereby only a small portion of the heating oxygen gas passes over to the cutting oxygen gas channel. Also provided in the cutting oxygen gas channel 8 is a check valve member 10. This is sited before the throttling connection passage 9, dictating that gas from the heating oxygen gas channel 7 is able to flow in the cutting oxygen gas channel 8 only in the direction towards the nozzle orifice. During the heating procedure, before the cutting oxygen gas is turned on, only a portion of the heating oxygen gas flow thus passes via the connection 9 over to the cutting oxygen gas channel and passes through this out through the nozzle orifice.

Through this gas flow in the cutting oxygen gas channel particles of dirt are prevented from being sucked up into this channel in the nozzle during the heating stage, thereby fouling and in the worst case obstructing the nozzle. The hot heating gas is also prevented from passing up into the cutting oxygen gas channel causing injurious heating of the nozzle. With the aid of the said partial gas flow from the heating oxygen gas flow, the hot heating gas is thus prevented from entering into the centre channel and instead this flow of gas causes the nozzle to be cooled. In addition, as mentioned, a cleaning of the cutting oxygen gas channel is attained.

Shown in FIG. 2 is a cross-section through a second embodiment of the arrangement according to the invention. This embodiment also comprises a burner body 1, in which is provided a nozzle 3 by means of a nozzle holder 2 as in the first embodiment. The cutting oxygen gas, heating oxygen gas and burner gas channels are here disposed in a manner similar to that according to the embodiment in FIG. 1. In the embodiment according to FIG. 2, no connection channel 9 or check valve 10 is provided in the burner body. According to this latter embodiment, the throttling connection channel 9 and check valve member 10 are provided in a separate body 11 which is sited between the burner body 1 and the valve body with the aid of a connector 12. The supply lines for the different gases are connected to the valve body (not shown in the figure).

In this latter embodiment also, the connection channel 9 and check valve 10 are so disposed that a certain portion of the heating oxygen gas flow is able to pass through the cutting oxygen gas channel only in the direction towards the nozzle orifice. Here too, the cleaning and cooling effect mentioned in connection with the description of FIG. 1 is obtained. The embodiments shown in the preceding refer to high-pressure burners with mixing in the nozzle. The described arrangement with connection between the heating oxygen gas line and the cutting oxygen gas line can naturally also be arranged in cutting burners of injector type within the compass of the present invention.

I claim:

1. In a cutting burner comprising a burner body for connection with a valve body to which supply lines for respective gases are connected, a nozzle, and a cutting oxygen gas channel, a heating oxygen gas channel and a burner gas channel being provided in the burner and connected with the nozzle, the improvement comprising a connection channel between the heating oxygen gas channel and the cutting oxygen gas channel, at least a part of the connection channel being of cross section much smaller than the cross section of the heating oxygen channel, and a check valve member located in said cutting oxygen gas channel before the connection channel, said connection channel and check valve member enabling a certain portion of the heating oxygen gas flow to permanently pass from the heating oxygen gas channel through the connection channel and the front part of the cutting oxygen channel toward the nozzle orifice, said certain portion of the heating oxygen gas flow preventing hot gases from passing up into the cutting oxygen gas channel from the heating procedure during use of the burner.

2. Apparatus as claimed in claim 1 wherein said connection channel and said check valve member are disposed within the burner body.

3. Apparatus as claimed in claim 1 wherein the connection channel and check valve member are disposed outside the burner body in a body disposed between the burner body and the valve body.

* * * * *